US011168677B2

(12) United States Patent
Flo et al.

(10) Patent No.: US 11,168,677 B2
(45) Date of Patent: Nov. 9, 2021

(54) PISTON PUMP, PARTICULARLY A HIGH-PRESSURE FUEL PUMP FOR AN INTERNAL COMBUSTION ENGINE

(71) Applicant: Robert Bosch GmbH, Stuttgart (DE)

(72) Inventors: Siamend Flo, Schwieberdingen (DE); Oliver Albrecht, Bietigheim-Bissingen (DE); Frank Nitsche, Remseck Am Neckar (DE); Olaf Schoenrock, Schwieberdingen (DE); Jurij Giesler, Korntal (DE); Andreas Plisch, Marbach (DE); Dietmar Uhlenbrock, Stuttgart (DE); Ekrem Cakir, Oberriexingen (DE)

(73) Assignee: Robert Bosch GmbH, Stuttgart (DE)

( * ) Notice: Subject to any disclaimer, the term of this patent is extended or adjusted under 35 U.S.C. 154(b) by 19 days.

(21) Appl. No.: 16/626,833

(22) PCT Filed: Jun. 7, 2018

(86) PCT No.: PCT/EP2018/065009
§ 371 (c)(1),
(2) Date: Dec. 26, 2019

(87) PCT Pub. No.: WO2019/015857
PCT Pub. Date: Jan. 24, 2019

(65) Prior Publication Data

US 2020/0224646 A1 Jul. 16, 2020

(30) Foreign Application Priority Data

Jul. 20, 2017 (DE) ..... 10 2017 212 501.2

(51) Int. Cl.
*F04B 19/04* (2006.01)
*F04B 1/0439* (2020.01)
(Continued)

(52) U.S. Cl.
CPC ..... *F04B 19/04* (2013.01); *F04B 1/0408* (2013.01); *F04B 1/0439* (2013.01); *F04B 1/0448* (2013.01); *F02M 59/442* (2013.01)

(58) Field of Classification Search
CPC .... F04B 19/04; F04B 1/0408; F04B 1/04039; F04B 1/0448; F02M 59/442
(Continued)

(56) References Cited

U.S. PATENT DOCUMENTS 5,209,495 A * 5/1993 Palmour ..... F04B 53/164 277/500
6,752,068 B2 * 6/2004 Onishi ..... F02M 55/004 92/168
2017/0314681 A1 * 11/2017 Nakagawa ..... F16J 15/34

FOREIGN PATENT DOCUMENTS

DE 195 19 833 A1 12/1996
DE 10 2012 217 260 A1 3/2014
(Continued)

OTHER PUBLICATIONS

English Translation of DE-102014225925-A1 obtained on Apr. 22, 2021 (Year: 2021).*
(Continued)

*Primary Examiner* — Connor J Tremarche
(74) *Attorney, Agent, or Firm* — Maginot, Moore & Beck LLP

(57) ABSTRACT

A piston pump, in particular high-pressure fuel pump for an internal combustion engine, includes a pump housing, a pump piston and a conveying chamber defined at least by the pump piston and the pump housing. A seal for sealing the conveying chamber and a separate guide element for guiding the pump piston may be arranged between the pump piston and the pump housing. The seal is designed as a metal sleeve, and may have a radially outwardly projecting web.

12 Claims, 7 Drawing Sheets

(51) Int. Cl.
*F04B 1/0408* (2020.01)
*F04B 1/0448* (2020.01)
*F02M 59/44* (2006.01)

(58) Field of Classification Search
USPC ..... 417/437
See application file for complete search history.

(56) References Cited

FOREIGN PATENT DOCUMENTS

| | | | | |
|---|---|---|---|---|
| DE | 10 2012 218 122 | A1 | 4/2014 | |
| DE | 10 2014 207 180 | A1 | 10/2015 | |
| DE | 10 2014 225 925 | A1 | 6/2016 | |
| DE | 102014225925 | A1 * | 6/2016 | ..... F02M 59/442 |
| DE | 10 2015 202 632 | A1 | 8/2016 | |
| DE | 102015202632 | A1 * | 8/2016 | ..... F04B 1/0443 |
| JP | S50-21123 | Y | 6/1975 | |
| JP | S60-84775 | U | 6/1985 | |
| JP | 2000-513782 | A | 10/2000 | |
| JP | 2008-25425 | A | 2/2008 | |
| JP | 2010-229914 | A | 10/2010 | |

OTHER PUBLICATIONS

English Translation of DE-102015202632-A1 obtained on Apr. 22, 2021 (Year: 2021).*
International Search Report corresponding to PCT Application No. PCT/EP2018/065009, dated Aug. 27, 2018 (German and English language document) (6 pages).

* cited by examiner

PISTON PUMP, PARTICULARLY A HIGH-PRESSURE FUEL PUMP FOR AN INTERNAL COMBUSTION ENGINE

This application is a 35 U.S.C. § 371 National Stage Application of PCT/EP2018/065009, filed on Jun. 7, 2018, which claims the benefit of priority to Serial No. DE 10 2017 212 501.2, filed on Jul. 20, 2017 in Germany, the disclosures of which are incorporated herein by reference in their entirety.

BACKGROUND

The disclosure relates to a piston pump, in particular a high-pressure fuel pump for an internal combustion engine.

Piston pumps which are used in internal combustion engines with gasoline direct injection, for example, are known from the prior art. Piston pumps of this kind have a gap seal between the pump cylinder and the pump piston. Pump cylinders and pump pistons are typically made of high-grade steel. A gap seal of this kind requires high precision during the production and assembly of the pump cylinder and pump piston which results in high costs. The constantly present gap, the size of which cannot be reduced at random on account of the thermal expansion coefficients of the materials used, for example, leads to sub-optimal volumetric efficiency, particularly at slow speeds.

SUMMARY

The problem addressed by the disclosure is that of creating a piston pump which has an adequate volumetric efficiency, even at slow speeds, and can be produced economically.

This problem is solved by a piston pump having the features of described herein. Advantageous developments of the piston pump are further specified in the disclosure.

The piston pump according to the disclosure has a pump housing, a pump piston and a conveying chamber at least also delimited by the pump housing and the pump piston. According to the disclosure, it is proposed that a seal for sealing the conveying chamber and a separate guide element for guiding the pump piston are arranged between the pump piston and the pump housing, wherein the seal is designed as a metal sleeve with a radially outwardly projecting web.

A piston pump of this kind may be produced comparatively easily, as a result of which the component costs are reduced. This is associated with the fact that the gap seal and the pump cylinder thereof, which is expensive to produce, are replaced by a seal assembly having a seal and at least one guide. The embodiment of the seal as a metal sleeve with a web means that advantageous sealing of the conveying chamber is achieved, so that volumetric efficiency is improved, in particular at slow speeds. The new seal assembly means that a comparatively small overall piston pump size can be achieved. The guide and sealing function are achieved by separate components, namely by the guide element and the seal (metal sleeve with web).

The pump piston may be received in a recess in the housing and moved up and down therein. The inner wall of the recess (circumferential wall) may form at least one portion of a running surface for the pump piston. The recess may be configured as a bore, in particular as a stepped bore.

Specifically, the (first) guide element may have an annular design (guide ring). The guide element may be arranged on the side of the seal facing the conveying chamber. The guide element in this case may have a radial gap (guide gap) facing the pump piston, which gap may be so small that the guide element is used as cavitation protection for the seal. The guide gap may be sufficiently small in design for no vapor bubbles to be able to reach the seal. The risk of damage to the seal is thereby reduced.

The seal is configured as a metal sleeve, preferably having a radially outwardly projecting web, so that the seal has a particularly L-shaped profile in cross section. The seal therefore has a sleeve portion and a web portion. The seal is based on a groove-ring seal but is optimized in design terms and has a radial web. The seal is, in particular, a high-pressure seal which seals a high-pressure region (conveying chamber) in respect of a low-pressure region (region on the side of the seal facing away from the conveying chamber).

The seal can be centered in a radial direction in the piston pump (recess) by the web. The seal may in this way be installed in a fixed position in the pump housing. The wall thickness of the metal sleeve depends on the system pressure and is designed accordingly. The wall thickness may be 0.05 mm-1.0 mm (millimeters), for example.

Within the framework of a preferred embodiment, a further guide element may be provided which is arranged in a seal carrier of the piston pump. In this way, a comparatively great bearing distance from the (first) guide element is achieved. Guidance of the piston pump is thereby optimized. The further guide element may be annular in design (guide ring).

A fastening ring for the seal may be advantageously arranged between the pump housing and the pump piston. The fastening ring is particularly arranged on the side of the seal facing away from the conveying chamber. The fastening ring creates a seat for the seal. In this way, the seal is secured to prevent axial displacement, particularly away from the conveying chamber. The fastening ring may be fastened, for example screwed, adhered or pressed in, to the recess receiving the pump piston. In particular, the fastening ring and the seal may be configured in such a manner that when the seal bears against the fastening ring, a static seal is created. In order to facilitate positioning in the radial direction between the piston and seal, it is advantageous for the seal to have an axial play of 0.01 mm-1 mm (millimeter), for example. It may therefore be a "floating seal" which is fixed neither axially nor radially. The seal may therefore be optimally positioned axially to the pump piston.

Within the framework of a preferred embodiment, the guide element and the fastening ring may be combined into one component, so in particular integrally formed. The combined component can then assume the guiding and fastening function. The number of elements to be produced and fitted can thereby be reduced. This promotes a cost-effective embodiment of the piston pump. The combined component and the seal may overlap one another axially. Hence, a portion of the combined component may be arranged radially between the pump piston and the pump housing.

It is advantageous for the web of the seal to have a radial play, for example of 0.01 mm-1 mm, on its radially outer edge in respect of the circumferential wall of the recess receiving the pump piston. In other words, the web has an outer diameter which is slightly smaller than the inner diameter of the recess (bore) receiving the pump piston at the point at which the web is located. Alternatively, expressed in even more general terms, the seal is radially movable relative to the pump housing. This play or radial movability means that the radial position of the seal can be precisely adjusted to the position of the pump piston. Consequently, a uniform and symmetrical gap in respect of the pump piston may result ("floating seal").

In each suction stroke of the pump piston (pump piston moves away from the conveying chamber) it is possible for the seal to be realigned. In the conveying phase (pump piston moves towards the conveying chamber, compresses and conveys fuel) a conveying pressure builds up above the seal (facing the conveying chamber) and radially outside the seal. The conveying pressure acts on the front side of the seal and on the web of the seal and causes the seal to experience force in the axial direction (axial direction of the pump piston) which presses the seal onto the fastening ring. During this phase, the seal cannot move, or only to a negligible extent, in the radial direction on account of the axial force. This axial force generates a pressing force which presses the seal onto the fastening ring. A static sealing point is created between these two faces (seal and fastening ring). In this way, fuel is prevented from escaping from the conveying chamber and thereby reducing the volumetric efficiency.

A spring element may preferably be arranged between the pump piston and the pump housing, which spring element presses the seal against the fastening ring. It is thereby ensured that the seal always rests against the static sealing point between the seal and the fastening ring. The spring may be a compression spring. The compression spring may be configured as a helical spring or as a corrugated spring.

As an alternative to this, the seal may have at least one spring element which is connected to the seal and which presses the seal against the fastening ring. It is also thereby possible to ensure that the seal rests against the static sealing point. In specific terms, the spring element or spring elements may be integrally formed with the seal. This reduces the number of components that have to be produced and assembled. The spring element or spring elements may extend starting from the sleeve portion or starting from the web portion of the seal. The spring element or spring elements may be configured as spring arms.

The seal may be a pressure-activated seal. This means that the small gap between the guide element and the pump piston is sufficient to produce an initial pressure in the conveying chamber and therefore also on the radially outer ring edge (rear side of the seal). Pressure on the rear of the seal causes said seal to deform and thereby reduces the gap in respect of the pump piston on the inner ring edge (sleeve portion). The increasingly small sealing gap means that a greater pressure can be generated in the conveying chamber and therefore also on the rear side of the seal, so that the seal is more severely deformed by the greater pressure and the gap in respect of the pump piston diminishes further. This is a self-reinforcing effect which continues until the system pressure is reached.

The seal geometry may be designed in such a manner that when the system pressure is reached either a very small gap of 0.001 mm to 0.1 mm, for example, is created or the seal rests directly against the pump piston and the sealing surfaces (of the seal and the pump piston) are mutually in contact. The question of whether there is still a gap present at system pressure or the seal is in direct contact with the piston depends on the specific requirements (volumetric efficiency, wear over service life, etc.). The pressure activation means that very high system pressures can be operated, since the higher the system pressure, the greater the deformation of the seal and therefore the smaller the sealing gap becomes.

The seal is low-wear in principle since tribological contact only takes place in the conveying phase (during pressure activation of the seal). This represents half the running time of the piston pump. In the suction phase (during which there is no pressure activation), the seal is particularly rinsed by fuel. Consequently, new fuel is constantly fed into the sealing gap and this acts as a lubricant. The pressure activation of the seal makes it possible for wear to be compensated for. When the sealing surface of the seal wears, the seal is routinely deformed by the pressure activation to the gap in the basic design or it rests against the pump piston.

In the context of a preferred embodiment, an O-ring may be arranged between the outer lateral surface of the seal and the pump housing. The O-ring has a radially sealing action. The static sealing point is supplemented by the O-ring and the sealing effect improved. The O-ring sits, in particular, on the web of the seal, namely on the side of the web facing the conveying space.

The seal may be advantageously arranged in such a manner that the web rests on the fastening ring. Consequently, a static sealing point may be formed between the web of the seal and the bearing surface of the fastening ring on which the web lies. In this way, a pressure-activated seal can be realized with a simple design, in particular as described above.

As an alternative to this, the fastening ring may have an axially projecting collar on which the web lies and the sleeve portion of the seal and the collar may overlap one another axially. Consequently, the static sealing point is formed between the web of the seal and the collar of the fastening ring. The seal is not then pressure-activated, as there is no high system pressure behind the seal (on the radially outer ring edge of the seal). As there is no pressure activation, the seal material and/or the geometry may be designed in such a manner that when the system pressure is applied, no or only a small deformation (expansion) of the seal takes place.

This can be achieved by a sufficiently great wall thickness (sleeve portion) of the seal, wherein the wall thickness may be 0.25 mm-2 mm, for example. The seal may have an oversize (press fit), undersize (play) or a transition fit in respect of the piston. For low friction and low wear, an embodiment of the seal with radial play relative to the pump piston, particularly with a play of 0.001-0.1 mm, is advantageous. The guidance of the piston and fastening of the seal may be largely identical to the previously described pressure-activated variant. The advantage of the non-pressure-activated sealing concept is that when the seal is designed with an undersize (play) in respect of the piston, there is no solid body between the seal and the piston contact at any operating point, since the system pressure which is applied at the dynamic sealing point constantly forces the seal to expand. This means that there is no wear to the seal or the piston over the service life.

Also in the case of the non-pressure-activated seal, at least one spring element which is separate or arranged on the seal may be provided, in order to ensure that the seal rests against the static sealing point. This design also has the advantage that excess pressures cannot occur in the high-pressure system, as the seal expands still further in the case of excess pressure and therefore allows a pressure drop. With an advantageous embodiment of this effect, it may be possible for a pressure limitation valve installed internally in the piston pump or externally in the fuel system to be dispensed with.

Within the framework of a preferred embodiment, the seal may be made of high-grade seal. Good corrosion resistance is thereby achieved. The seal is preferably made of high-grade steel with identical or comparable length expansion coefficients to the pump piston and the housing. In this way, the seal is independent of the thermal expansion of the pump piston and the pump housing.

BRIEF DESCRIPTION OF THE DRAWINGS

The disclosure is explained in greater detail below, wherein identical or functionally identical elements are only provided with one reference number. In the drawing.

DETAILED DESCRIPTION

Figure 1:
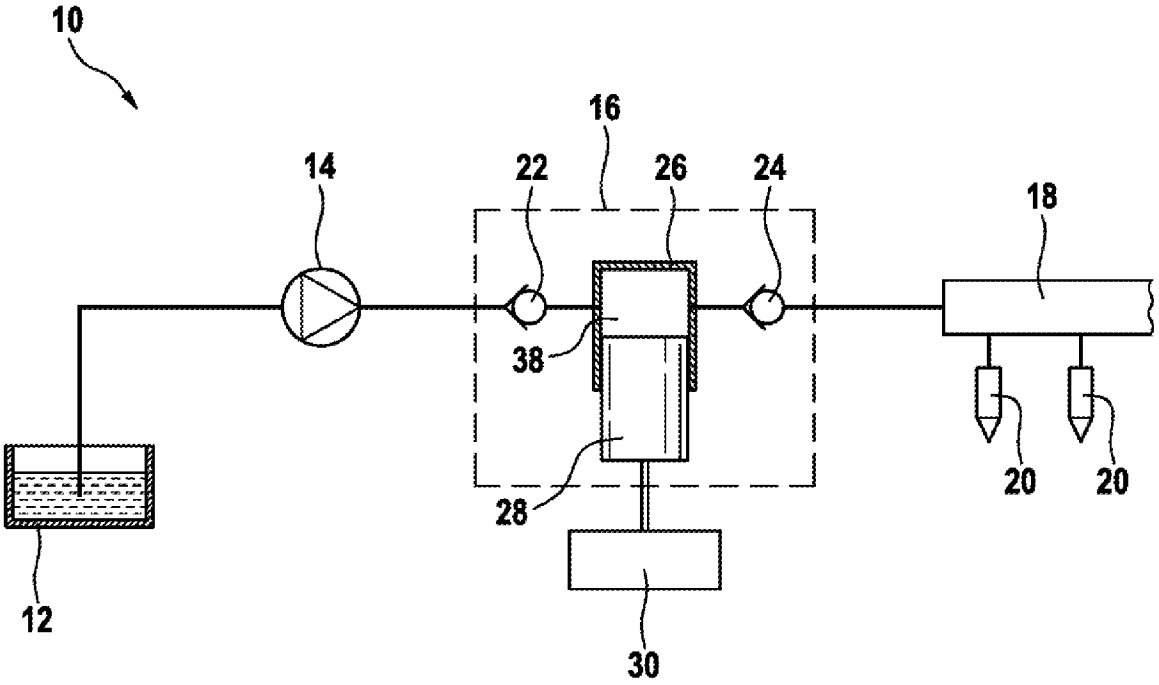
FIG. 1 shows a schematic representation of the fuel system with a high-pressure fuel pump in the form of a piston pump.

A fuel system of an internal combustion engine is given the overall reference number 10 in FIG. 1. It comprises a fuel container 12 from which an electric conveying pump 14 conveys fuel to a high-pressure fuel pump configured as a piston pump 16. This further conveys the fuel to a high-pressure fuel rail 18 to which multiple fuel injectors 20 are attached which inject the fuel into combustion chambers of the internal combustion engine which are not shown.

The piston pump 16 comprises an inlet valve 22, an outlet valve 24, and a pump housing 26. A pump piston 28 is received in said pump housing such that it can move back and forth. The pump piston 28 is set in motion by a drive 30, wherein the drive 30 is only depicted schematically in FIG. 1. The drive 30 may be a cam shaft or an eccentric shaft, for example. The inlet valve 22 is configured as a volume control valve through which the amount of fuel conveyed by the piston pump 16 can be set.

The design of the piston pump 16 emerges in greater detail from FIG. 2, wherein only the essential components are mentioned below. The pump piston 28 is configured as a stepped piston with a lower tappet portion 32 in FIG. 2, a guide portion 34 attached thereto, and an upper end portion not depicted in greater detail. The guide portion 34 has a greater diameter than the tappet portion 32 and the end portion.

The end portion and the guide portion 34 of the pump piston 28 delimit along with the pump housing 26 a conveying chamber 38 which is not depicted in greater detail. The pump housing 26 may be configured as a rotationally symmetrical part overall. The pump piston 28 is received in the pump housing 26 in a recess 40 which is present there and which is configured as a stepped bore 42. The bore 42 has multiple steps (three steps 42', 42", 42'"; see FIGS. 2 and 3).

Between the guide portion 34 of the pump piston 28 and an inner circumferential wall of the bore 42 (step 42") is arranged a seal 44. It creates a direct seal between the pump piston 28 and the pump housing 26 and thereby seals the conveying space (high-pressure region) located above the seal 44 in respect of the region (low-pressure region) arranged below the seal 44 in FIG. 2, in which the tappet portion 32 of the pump piston 28, among other things, is located. The seal 44 is configured as a metal sleeve with a radially outwardly projecting web 45. The seal 44 has an L-shaped cross section which has a sleeve portion 43 and the portion (web portion) formed by the web 45.

Between the guide portion 34 of the pump piston 28 and the inner circumferential wall of the bore 42 (step 42') is arranged a guide element 46 separate from the seal 44. The guide element 46 is arranged axially particularly directly adjacent to the seal 44 and in FIG. 2 above the seal 44 (facing the conveying chamber). The guide element 46 is annular in design (guide ring) and may be fastened to the step 42'.

Figure 2:
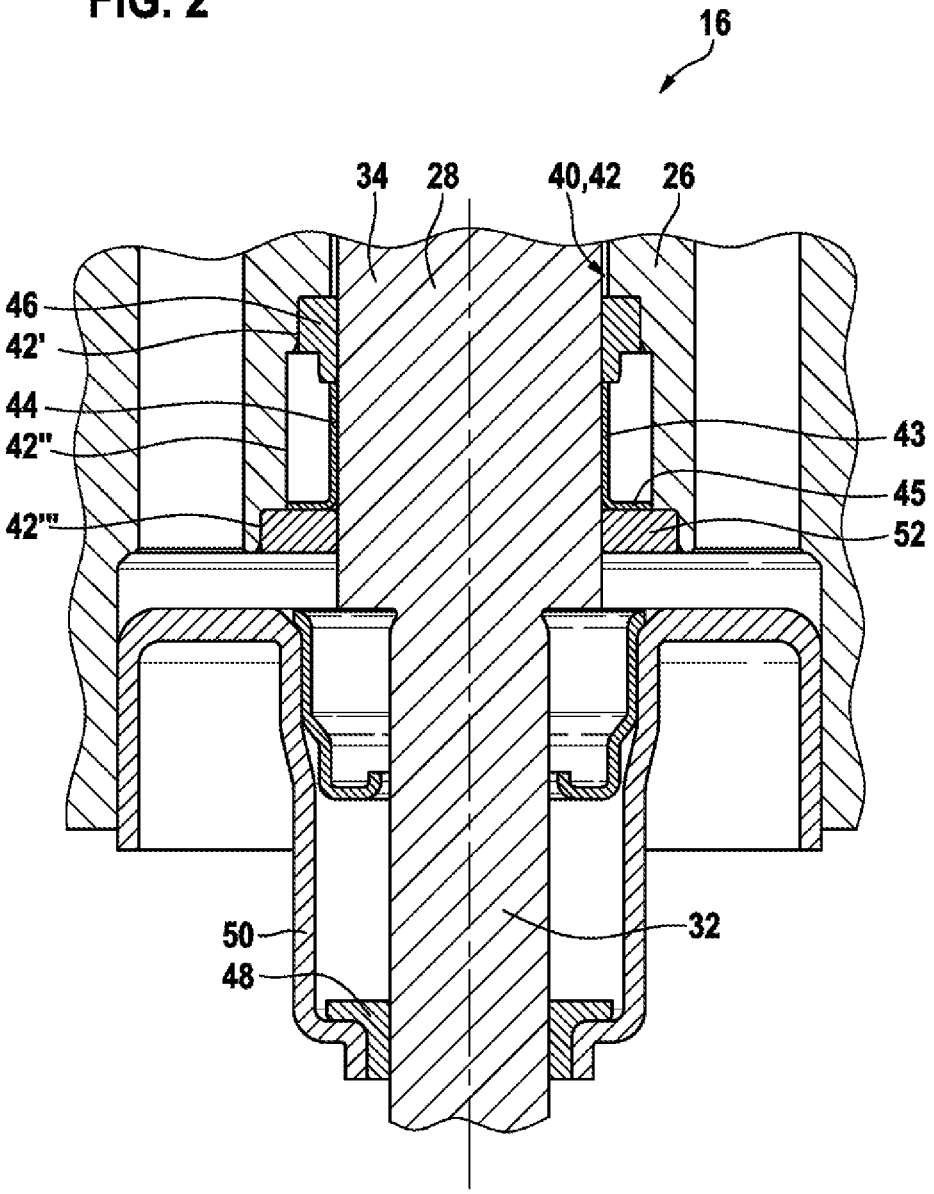
FIG. 2 shows a partial longitudinal section through the piston pump in FIG. 1.

The piston pump 16 has a further guide element 48 which is arranged in a seal carrier 50 of the piston pump 16 (see FIG. 2). The guide element 46 and the further guide element 48 are used to guide the pump piston 28. The further guide element 48 is annular in design (guide ring) and may be fastened to the seal carrier 50.

The piston pump 16 has a fastening ring 52 for the seal 44 between the guide portion 34 of the pump piston 28 and the inner circumferential wall of the bore 42 (step 42'"). The seal 44 lies on the fastening ring 52, namely such that the web 45 lies on the fastening ring 52. A static sealing point 53 is created by the resting contact surfaces of the seal 44 and fastening ring 52 (see FIG. 3). The seal 44, the guide element 46, the further guide element 48, and the fastening ring 52 form a sealing assembly. The seal 44 may be made of high-grade steel.

Figure 3:
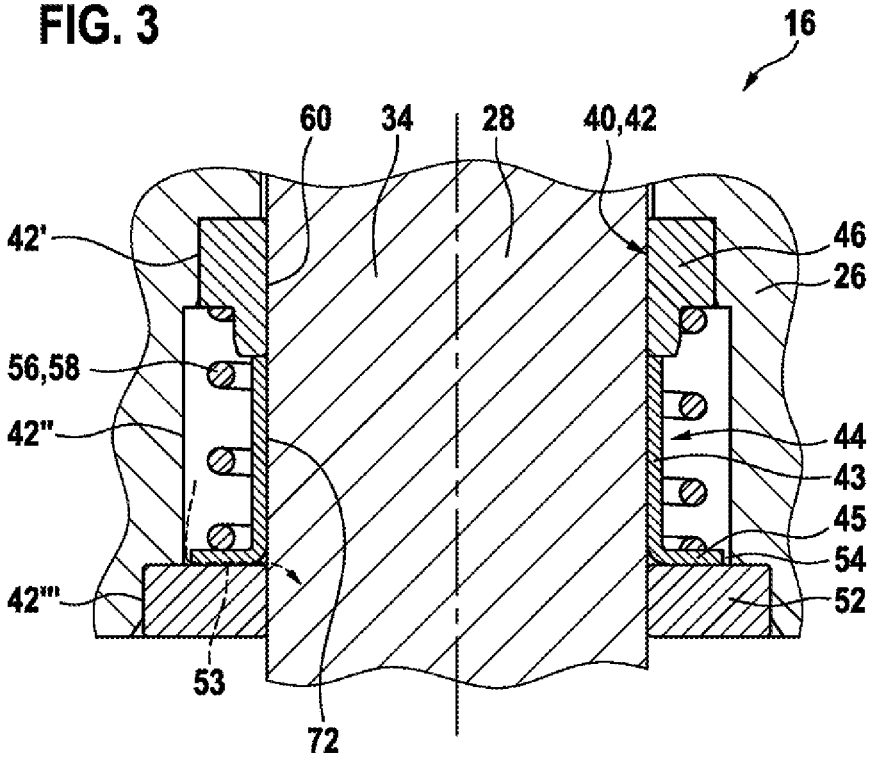
FIG. 3 shows an enlarged view of a pump piston, a seal, a guide element, a fastening ring, and a spring element of the piston pump from FIG. 1.

The web 45 projecting radially from the seal 44 has a radial play 54 on its radially outer edge in respect of the inner circumferential wall of the recess 40 (step 42") receiving the pump piston 28 (see FIG. 3). In this way, the seal 44 may be aligned in a radial direction relative to the pump piston 28. A spring element 56 is arranged between the pump piston 28 and the pump housing 26 which presses the seal 44 against the fastening ring 52. The spring element 56 is a helical spring 58 designed as a compression spring. This may rest against the guide element 46 at one end, for example, and against the web 45 of the seal 44 at the other end.

Figure 4:
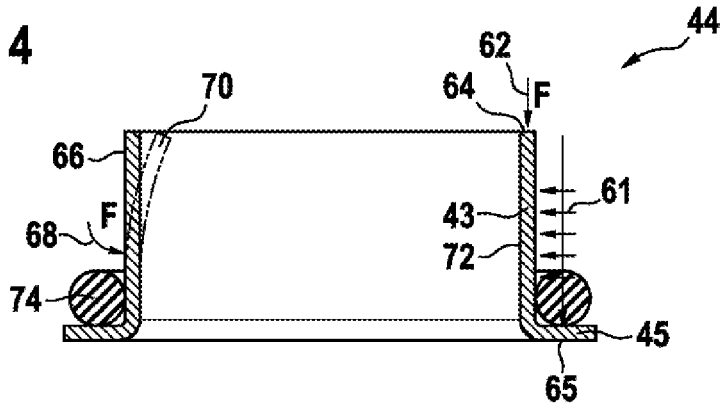
FIG. 4 shows the seal from FIG. 3 as an enlarged sectional view.

Via the radial gap 60 (guide gap) which can be used as described above as cavitation protection for the seal 44, the pressure 61 prevailing in the conveying chamber 38 reaches the seal 44. At that point, this pressure acts with a force F (arrow 62) on the first front side 64 of the seal 44 (see FIG. 4). In this way, the seal 44 is pressed against the fastening ring 52. In addition, the pressure 61 also acts on the outer lateral surface 66 of the seal 44, so that the seal 44 undergoes deformation 70 on account of the force F acting there (arrow 68). Consequently, a dynamic sealing point is formed between the pump piston 28, in particular between the guide portion 34, and the seal 44 (radially inner ring edge 72). An O-ring 74 may be optionally arranged between the outer lateral surface 66 of the seal 44 and the pump housing 26

(step 42"). The O-ring 74 may lie on the web 45. The O-ring 74 has a radially sealing action and supports the static sealing point 53. The second front side of the seal 44 bears the reference number 65.

Figure 5:
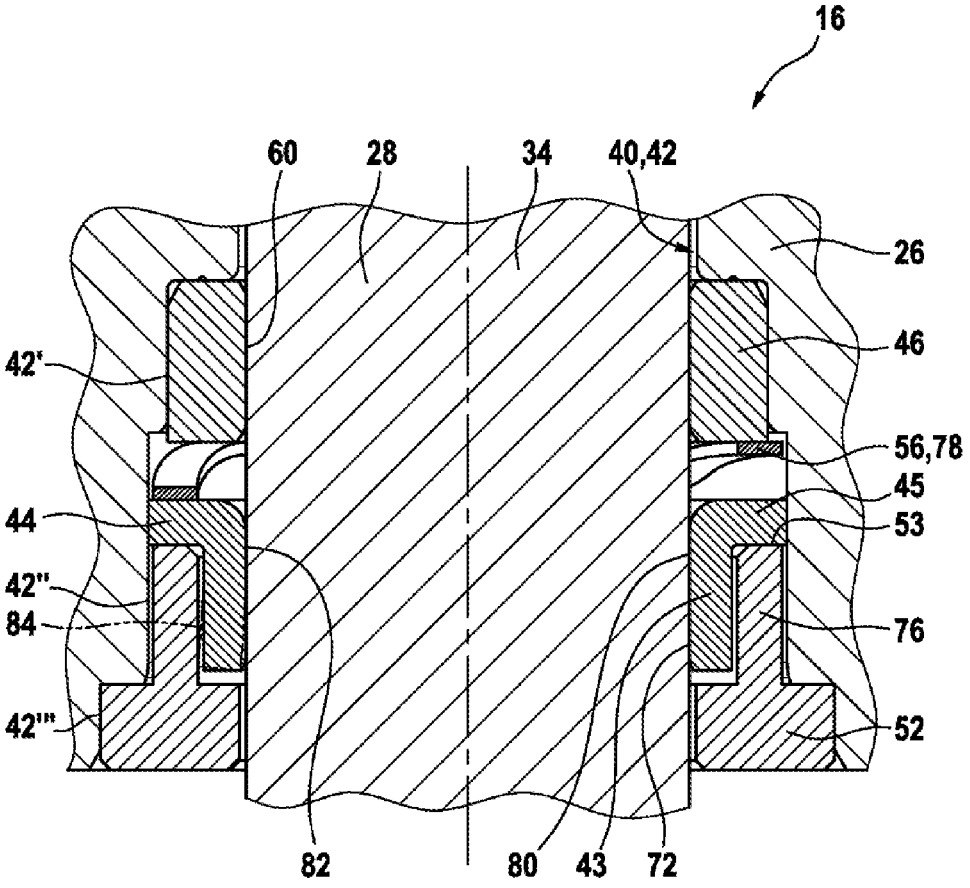
FIG. 5 shows a partial longitudinal section through an alternative embodiment of the piston pump from FIG. 1.

FIG. 5 shows an alternative embodiment of the piston pump 16 from FIG. 2. This embodiment largely corresponds to the piston pump 16 described above, wherein identical or functionally identical elements are provided with the same reference numbers.

The fastening ring 52 according to FIG. 5 has an axially (in the axial direction of the pump piston 28) projecting collar 76 which projects into the recess 40. The seal 44 is arranged in such a manner that the web 45 lies on the collar 76. The sleeve portion 43 of the seal and the collar 76 overlap one another axially. The collar 76 is arranged radially between the sleeve portion 43 and the inner circumferential wall of the recess 40 (step 42"). The seal 44 is formed on the sleeve portion and on the web portion 45 with a greater wall thickness. The static sealing point 53 is created between the web 45 and the collar 76. The spring element 56 is configured as a compression spring in the form of a corrugated spring 78.

The radially inner ring edge 72 of the seal 44 has play in respect of the pump piston 28, in particular in respect of the guide portion 34 of the pump piston 28. Consequently, there is no contact between the seal 44 and the pump piston 28 in any operating state of the piston pump 16, since the pressure reaching the dynamic sealing point 82 from the conveying chamber 38 acts on the seal 44 such that said seal undergoes deformation 84 and expands. This means that there is no wear to the seal 44 or the pump piston 28 over the service life.

Figure 6:
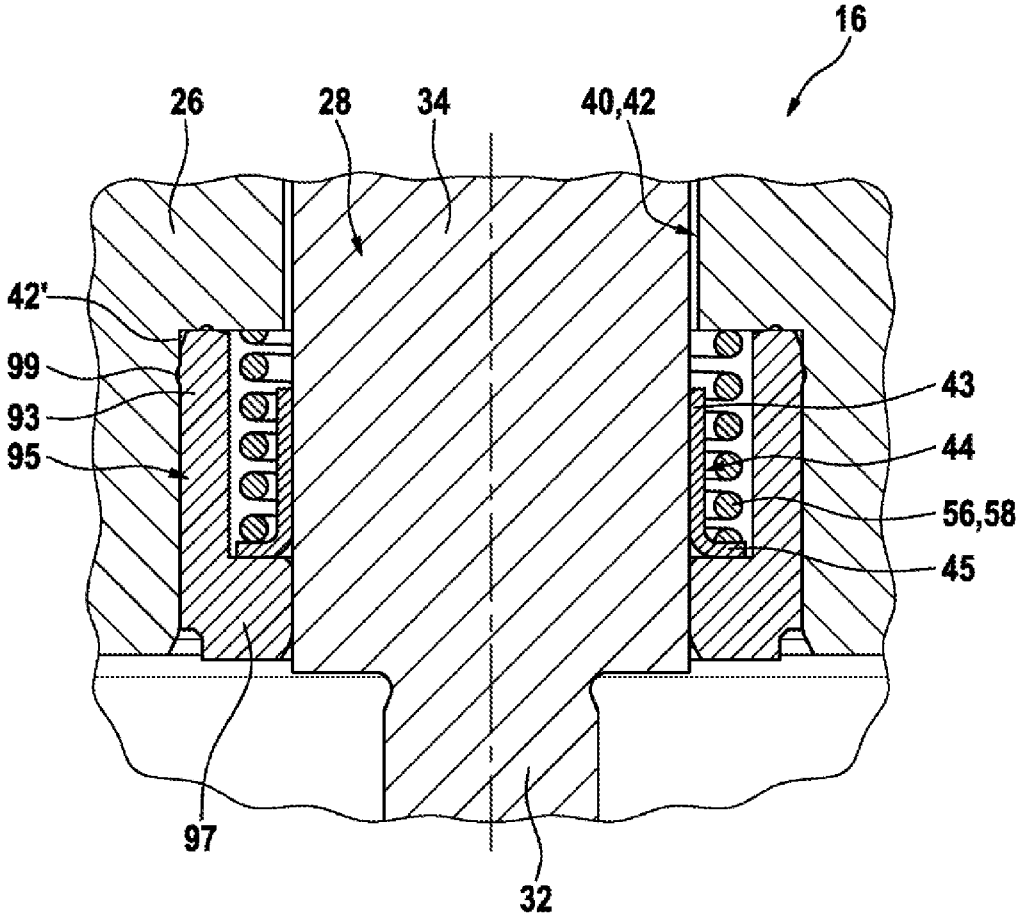
FIG. 6 shows a partial longitudinal section through a further alternative embodiment of the piston pump from FIG. 1.

FIG. 6 shows a further alternative embodiment of the piston pump 16 from FIG. 2. This embodiment largely corresponds to the piston pump 16 described above in relation to FIGS. 1 to 4, wherein identical or functionally identical elements are provided with the same reference numbers.

In the present embodiment, the first guide element 46 and the fastening ring 52 are combined into one component 95 (integral design). The component 95 assumes the guiding and fastening function. The combined component 95 and the seal 44 overlap one another axially (axial direction of the pump piston 28). Hence, an overlapping portion 93 of the combined component 95 is arranged radially between the pump piston 28 (guide portion 34) and the pump housing 26 (circumferential wall 42' of the bore 42).

The guidance may take place on a lower portion 97 of the component 95. The fastening of the component 95 in the bore 42 may take place in the lower portion 97 or in the overlapping portion 93 of the component 95, for example by means of an interference fit, caulking or a projection 99 protruding radially outwardly from the component 95.

FIGS. 7 to 10 show possible embodiments of the seal 44 in which the seal 44 itself has at least one spring element 56 (integral design). A separate spring element can be dispensed with. In this way, the production and assembly of the piston pump 16 are simplified. A seal 44 of this kind with a spring element 56 configured thereon may be used both in a piston pump 16 according to FIG. 2 and also in a piston pump 16 according to FIG. 5 or

FIG. 6.

Figure 7:
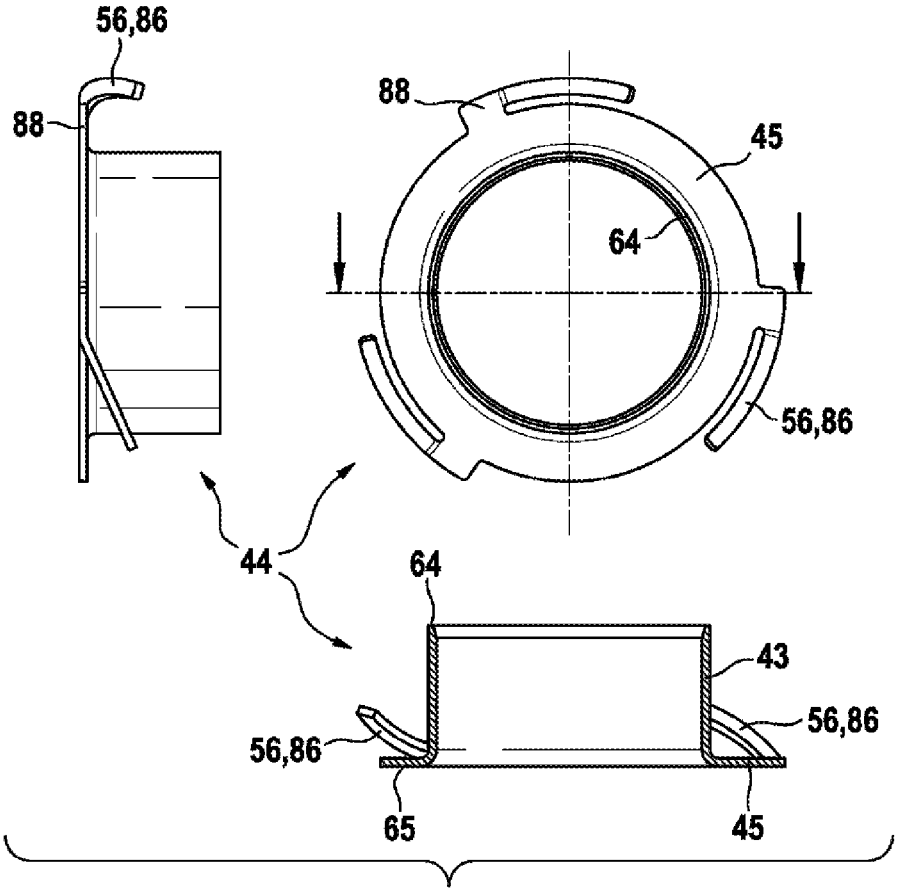
FIG. 7 shows the seal of the piston pump from FIG. 1 with connected spring elements in multiple, partially sectional views.

FIG. 7 shows a seal 44 which has three spring elements 56 which are configured as spring arms 86. The spring arms 86 extend starting from the web portion 45 of the seal 44. The spring arms 86 each extend from an edge portion 88 projecting beyond the outer edge of the web portion 45. The spring arms 86 in this case have a curved shape in plan view and project axially from the web portion 45 (towards the front side 64 of the seal 44).

Figure 8:
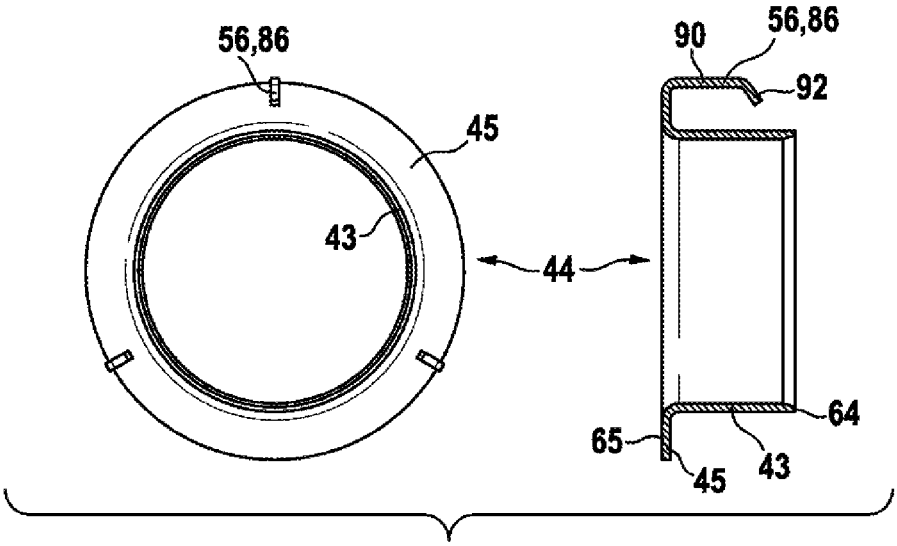
FIG. 8 shows the seal of the piston pump from FIG. 1 with connected spring elements in multiple, partially sectional views as an alternative embodiment.

The seal 44 according to FIG. 8 likewise has three spring arms 86 which extend from the web portion 45 of the seal 44 axially from the web portion 45. In this case, the spring arms 86 extend from the radially outer edge of the web portion 45. The spring arms 86 each have an arm portion 90 parallel to the sleeve portion 43 of the seal 44 and an angled arm portion 92.

Figure 9:
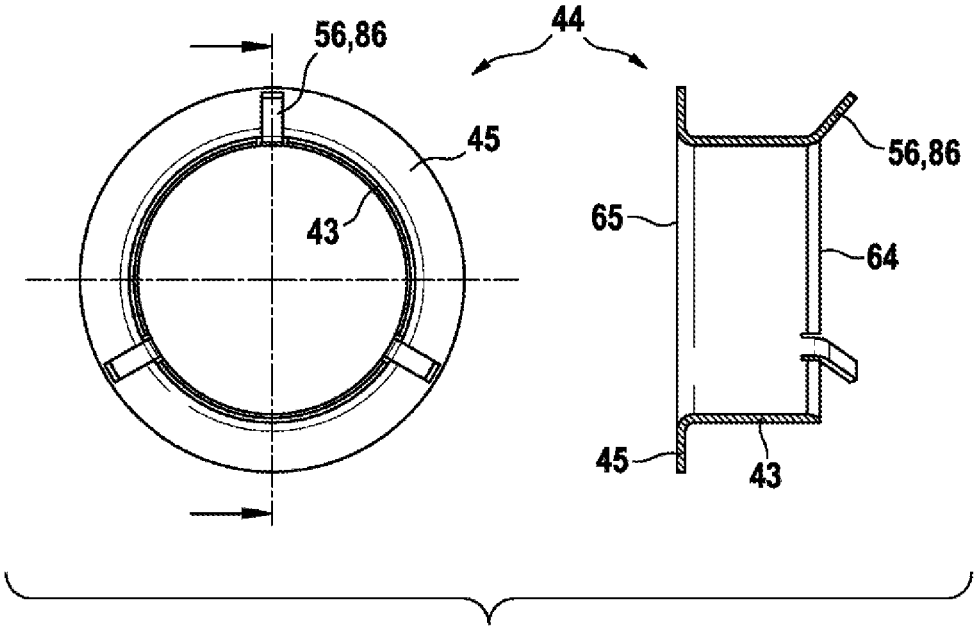
FIG. 9 shows the seal of the piston pump from FIG. 1 with connected spring elements in multiple partially sectional views as an alternative embodiment.

The seal 44 according to FIG. 9 likewise has three spring arms 86 which extend away from the sleeve portion of the seal 44. In this case, the spring arms 86 project away from the first front side 64 of the seal 44 and are angled in respect of the sleeve portion 43.

Figure 10:
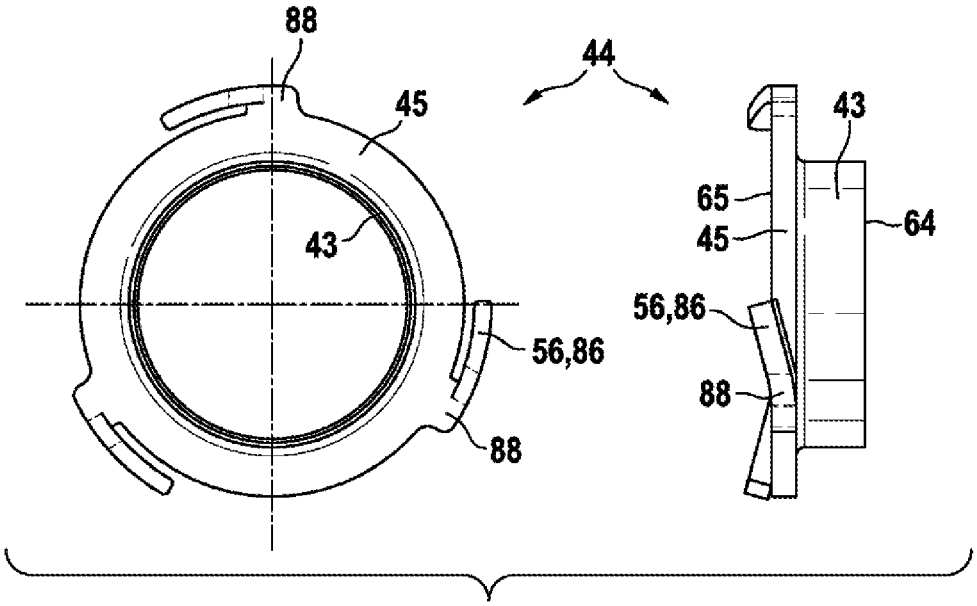
FIG. 10 shows the seal of the piston pump from FIG. 1 with connected spring elements in multiple partially sectional views as an alternative embodiment.

The embodiment of the seal 44 according to FIG. 10 largely corresponds to the seal 44 shown in FIG. 7. Notwithstanding this, in the seal 44 according to FIG. 9 the spring arms 86 extend from the web portion 45 to the side of the web portion 45 facing away from the sleeve portion 43. The spring arms 86 in this case project beyond the second front side 65 of the seal 44.

The invention claimed is:

1. A piston pump comprising:

a pump housing;

a pump piston;

a conveying chamber defined by the pump piston and the pump housing;

a guide element that guides the pump piston and is arranged between the pump piston and the pump housing; and a seal that seals the conveying chamber and is arranged between the pump piston and the pump housing, wherein the seal is configured as a metal sleeve having a radially outwardly projecting web, and wherein a play is defined between a radially outer edge of the web and a circumferential wall of a recess in which the pump piston is received such that the seal is radially movable relative to the circumferential wall of the recess.

2. The piston pump as claimed in claim 1, further comprising:

a fastening ring for the seal arranged between the pump piston and the pump housing.

3. The piston pump as claimed in claim 2, wherein the guide element and the fastening ring are combined into one component.

4. The piston pump as claimed in claim 1, further comprising:

a seal carrier; and a second guide element arranged in the seal carrier.

5. The piston pump as claimed in claim 2, further comprising:

a spring element arranged between the pump piston and the pump housing, the spring element pressing the seal against the fastening ring.

6. The piston pump as claimed in claim 2, wherein the seal has at least one spring element which is connected to the seal and which presses the seal against the fastening ring.

7. The piston pump as claimed in claim 1, further comprising:

an O-ring arranged between an outer lateral surface of the seal and the pump housing.

8. The piston pump as claimed in claim 2, wherein the seal is arranged such that the web rests on the fastening ring.

9. The piston pump as claimed in claim 1, wherein:

the fastening ring has an axially projecting collar on which the web lies; and a sleeve portion of the seal and the collar axially overlap one another.

10. The piston pump as claimed in claim 1, wherein the piston pump is a high-pressure fuel pump.

11. The piston pump as claimed in claim 1, wherein the seal is formed of steel.

12. The piston pump as claimed in claim 1, wherein the play is between 0.01 mm and 1 mm.

* * * * *